US006145311A

United States Patent [19]

Cyphelly

[11] Patent Number: 6,145,311

[45] Date of Patent: Nov. 14, 2000

[54] PNEUMO-HYDRAULIC CONVERTER FOR ENERGY STORAGE

[76] Inventor: Ivan Cyphelly, Case postale 18, CH-2416 Les Brenets, Switzerland

[21] Appl. No.: 09/068,091

[22] PCT Filed: Nov. 1, 1996

[86] PCT No.: PCT/CH96/00386

§ 371 Date: May 1, 1998

§ 102(e) Date: May 1, 1998

[87] PCT Pub. No.: WO97/17546

PCT Pub. Date: May 15, 1997

[30] Foreign Application Priority Data

Nov. 3, 1995 [CH] Switzerland ..... 3114/95

[51] Int. Cl.[7] ..... F15B 21/04

[52] U.S. Cl. ..... 60/456; 92/144; 417/258; 417/372

[58] Field of Search ..... 60/456; 92/144; 417/258, 372, 396

[56] References Cited

U.S. PATENT DOCUMENTS

| | | | |
|---|---|---|---|
| 129,631 | 7/1872 | Waring | 92/144 |
| 255,116 | 3/1882 | Rand | 92/144 |
| 4,761,118 | 8/1988 | Zanarini | 417/396 |
| 4,818,192 | 4/1989 | Korthaus | 417/372 |
| 5,564,912 | 10/1996 | Peck et al. | 417/396 |

FOREIGN PATENT DOCUMENTS

| | | | |
|---|---|---|---|
| 483621 | 9/1929 | Germany | 417/258 |

*Primary Examiner*—F. Daniel Lopez
*Attorney, Agent, or Firm*—Dykema Gossett PLLC

[57] ABSTRACT

In order to maintain high efficiency close, to isothermy despite high frequencies in a pneumo-hydraulic converter with reciprocating pistons, pipe cluster-heat exchange pipes (38) are provided in the gas working chambers of the converter and the exchange fluid in the pipes is kept at approximately ambient temperature. For this the gas working chambers must be arranged axially next to one another and, in order to eliminate dead space, connected in pairs by conical exchange valves **(12*a*/12*b*) which take in the entire wall thickness of the valve flange (5*a*/5*b*)** dividing the air chambers.

19 Claims, 2 Drawing Sheets

PNEUMO-HYDRAULIC CONVERTER FOR ENERGY STORAGE

BACKGROUND OF THE INVENTION

A pneumo-hydraulic converter with reciprocating double piston which connects a compressed air storage and a hydraulic circuit at maximum efficiency in such a way that energy can flow into the storage (charging) or can be removed from the storage (discharging) is known.

The good efficiency of isothermal processes is obtained in the above system by stabilizing the temperature in the working chambers (piston spaces) during each stroke by means of the operating medium, i.e., oil. This will result in relatively slow working processes, since the limited velocity of the heat transfer from the lateral surface of the cylinder to the air during the working stroke cannot compensate the temperature fluctuations at increased cycle frequency. As a consequence, the structual units employed are comparatively large in relation to the power involved.

It is the object of this invention to achieve good efficiency while increasing the cycle frequency at the same time.

SUMMARY OF THE INVENTION

According to the invention tubular heat exchangers pass through some of the working chambers of the converter and an exterior circuit maintains the exchange fluid approximately at ambient temperature.

This heat exchanger may either be carried along by the set of reciprocating pistons, or remain stationary. Since the heat exchanger moving along with the pistons will require fewer sliding sealings (approximately by one third), and the bundle of tubes will considerably increase the buckling and deflection strength of the piston set, the present description will be restricted to presenting the converter with movable heat exchanger. To achieve the desired increase in cycle frequency, an arrangement of working chambers is called for which involves a dramatic reduction of dead volumes and will hence generate high buckling forces. As a consequence, buckling strength will become an extremely important structural factor which must also be allowed for when deciding on the arrangement of the valves.

As the converter is designed to operate as both compressor and decompressor, the valve sets on each side—each consisting of high-pressure valve, exchange valve, low-pressure valve—must be subject to forced control; under certain conditions it is possible to pair off the movements of exchange valve and low-pressure valve. The configuration of these valves must fulfill the topological requirements of the heat exchanger as well as the strict demand for the smallest possible dead volumes. The solution of these tasks and the operation of the device proposed by this invention will now be explained by means of the accompanying drawings.

DETAILED DESCRIPTION OF THE PREFERRED EMBODIMENT

In its high-pressure variant the converter includes three coaxial and approximately equal lengths of cylindrical pipe:

the pre-pressure pipe 1 and the high pressure chamber pipes 3*a,* 3*b,* the pre-pressure pipe 1 containing the pre-pressure piston 2 and having a significantly larger diameter than the two high-pressure chamber pipes 3*a,* 3*b* which are symmetrically arranged vis-a-vis the pre-pressure pipe 1 and contain the equally symmetrical high-pressure pistons 4*a,* 4*b.* Since both movable and stationary parts are mirror-symmetrical relative to the longitudinal centre plane, the pre-pressure pipe 1 is connected via valve flanges 5*a,* 5*b* to the two screwed-in high-pressure chamber pipes 3*a,* 3*b,* which are closed off on the other ends by fitting covers 7*a,* 7*b* fastened by screw caps 6*a,* 6*b.* Axially sliding in the cylindrical pipes are a set of three pistons which are rigidly connected by the tubular rod 8 and will thus define 2×3 working chambers, i.e., oil chambers 9*a,* 9*b* between covers 7*a,* 7*b* and high-pressure pistons 4*a,* 4*b;* air high-pressure chambers 10*a,* 10*b* between high-pressure pistons 4*a,* 4*b* and valve flanges 5*a,* 5*b;* and air pre-pressure chambers 11*a,* 11*b* between valve flanges 5*a,* 5*b* and pre-pressure piston 2. The air high-pressure chambers 10*a,* 10*b* are connected to the air pre-pressure chambers 11*a,* 11*b* via the exchange valves 12*a,* 12*b;* communication between the pre-pressure chambers 11*a,* 11*b* and the exterior is established via the low-pressure valves 13*a,* 13*b;* air from the air storage 14 is admitted into the air high-pressure chambers 10*a,* 10*b* via the high-pressure valves 15*a,* 15*b,* which are supplied from the air storage 14 via feed lines 16*a,* 16*b* and fittings 17*a,* 17*b.*

Figure 1:
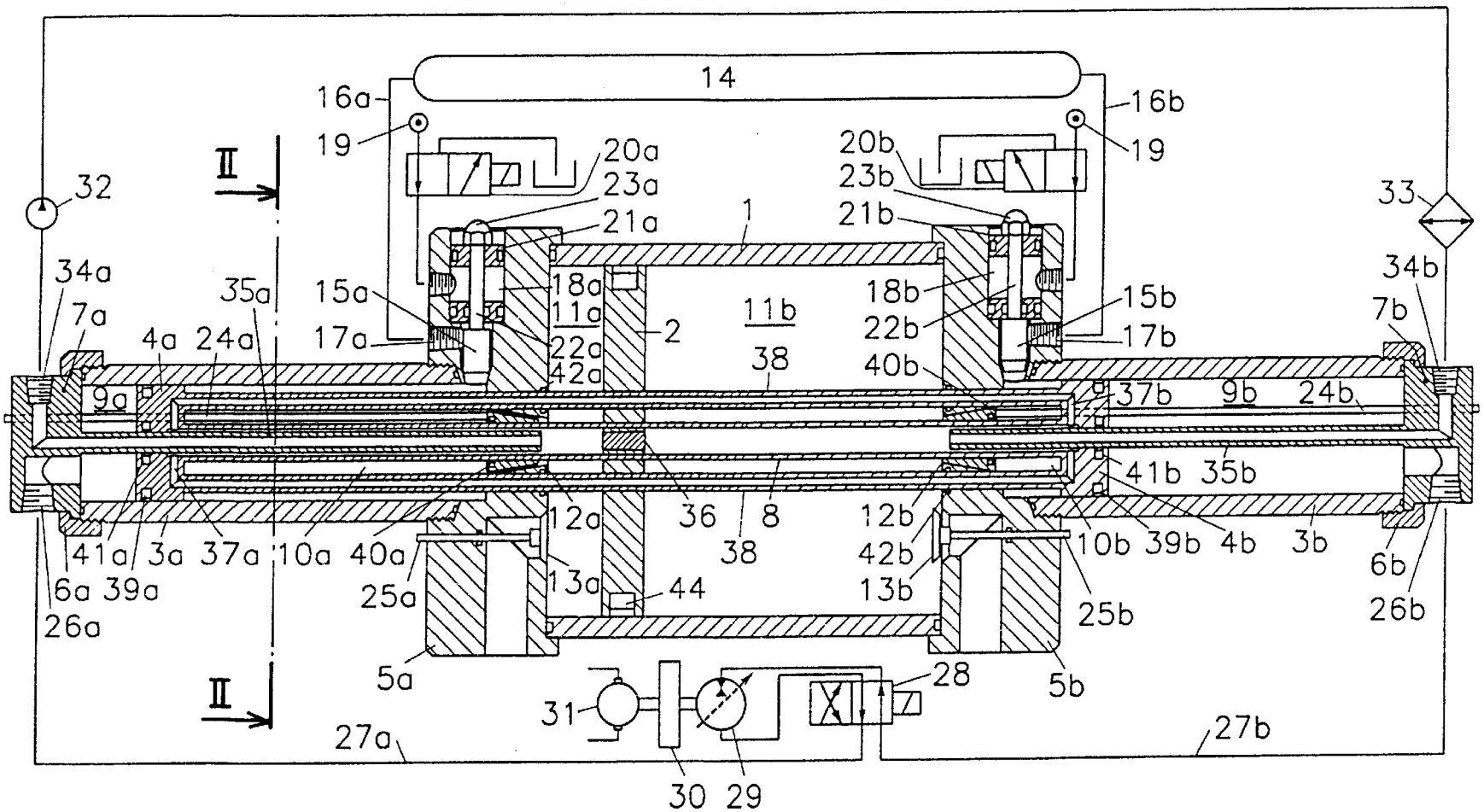
FIG. 1 is a longitudinal section through the axis of the four cylindrical working chambers.
Figure 2:
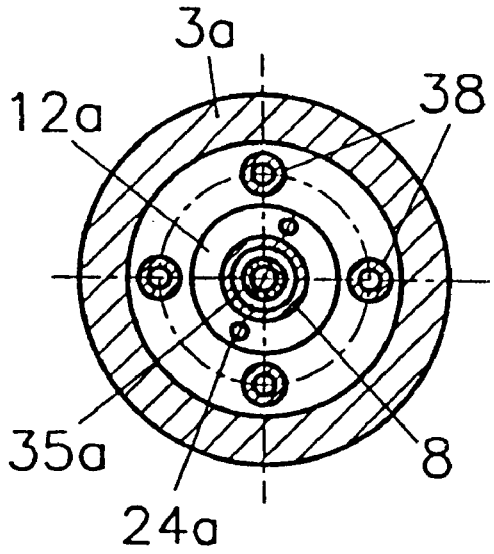
FIG. 2 is a section transversely to the axis in FIG. 1, through the high-pressure chamber and through the tube bundle of the heat exchanger.

One variant of hydraulic pilot control is shown employing the high-pressure valves 15*a,* 15*b* in FIG. 1, where the pressure chambers 18*a,* 18*b* are either depressured or pressured by electric two-way pilot valves 20*a,* 20*b* connected to a pressure source 19, such that the valve pistons 21*a,* 21*b* are set into motion, which are connected to the high-pressure valves 15*a,* 15*b* via rods 22*a,* 22*b* and nuts 23*a,* 23*b.* Similar devices may be provided for the exchange valves 12*a,* 12*b* and the low-pressure valves 13*a,* 13*b,* whose actuating rods 24*a,* 24*b* and 25*a,* 25*b* are shown only.

For better understanding of the functional principle of the converter, a possible working environment for the converter is included in FIG. 1, beginning at the oil fittings 26*a,* 26*b,* with feed lines 27*a,* 27*b* leading to a four-way valve 28 acting on a variable hydrostatic unit 29 with flywheel 30 and electromotor/generator 31. The exchange circuit begins at the feed pump 32, which delivers the exchange fluid through the external exchanger 33 via fitting 34*b* in cover 7*b* and via feeder pipe 35*b* to the tubular rod 8. As the tubular rod 8 is stopped by a conical plug 36 in the plane of the pre-pressure piston 2, the exchange fluid is pushed back through the annular space between feeder pipe 35*b* and tubular rod 8 towards the high-pressure piston 4*b,* where the fluid is delivered to the bundle of heat exchange pipes 38 (and thus to the piston 4*a* itself) via radial bores 37*b,* and where the tubular rod 8 is reached in turn via radial bores 37*a;* the loop back to the feed pump 32 is closed via feeder pipe 35*a* and fitting 34*a* in cover 7*a.*

Figure 3:
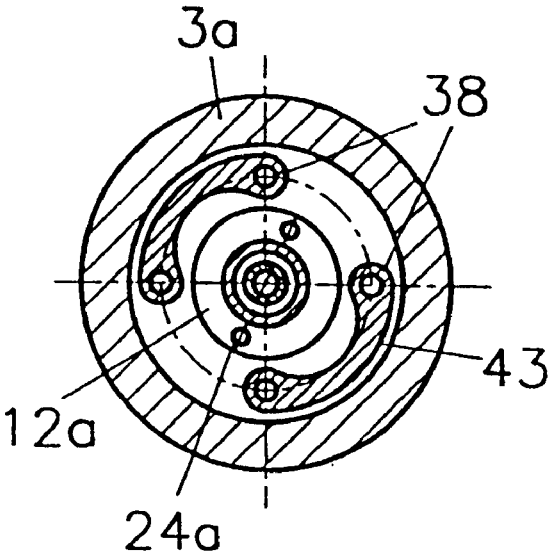
FIG. 3 illustrates the same section as FIG. 2, though with a bridge across the tubes of the bundle.

Like the high-pressure piston sliding sealings 39*a,* 39*b* and the exchange valve sliding sealings 40*a,* 40*b,* the exchanger sealings 41*a,* 41*b* and 42*a,* 42*b* are subject to the full pressure difference throughout the entire period of piston movement. This is the actual technological challenge of the design, in particular if the configuration of the tube bundle includes a bridge 43 as shown in FIG. 3, in order to increase buckling strength and improve heat transfer. It is only the sliding sealing 44 of the pre-pressure piston 2 that is not exposed to the high pressures, as it is only subject to the pre-pressure. The remaining sealings, which are not referred to in detail, are only subject to static pressures or short-stroke movements.

The functional principle of the converter will now be discussed with reference to a decompression (discharge) cycle corresponding to the position of valves shown here, where the pistons move towards the right: at the moment shown in the drawing the air high-pressure chamber 10*b* is directly connected to the air storage 14 through the open air high-pressure valve 15*b*. The pressure force acts on the oil chamber 9*b* and is transmitted via the oil column in line 27*b* and the four-way valve 28 to the pressure side of the hydrostatic unit 29 acting as a motor, which in turn will actuate the flywheel 30 and the generator 31. Moreover, due to this movement to the right decompressed air in chamber 11*b* is pushed out into the open by the pre-pressure piston 2 through the open low-pressure valve 13*b;* at the same time the air from the previous movement which has remained under pre-pressure in the high-pressure chamber 10*a,* will assume discharge pressure via the open exchange valve 12*a* due to the expanding pre-pressure chamber 11*a*. By the same movement the oil emerging from the hydrostatic unit is forced into the oil chamber 9*a*. The force picked up by the cushion in the oil chamber 9*b* is thus generated not only by the exposure to high pressure in the air high-pressure chamber 10*b,* but also by the thrust produced by the pre-pressure at the large surface of the pre-pressure piston 2, which is transmitted via the tubular rod 8 and pipes 38 of the tube bundle. This is the very site where the danger of buckling is encountered. At a certain moment of this movement to the right, which is to be determined by computer, the high-pressure valve 15*b* must be closed, for the decompression of the thus defined volume to yield at the end of the stroke precisely that pre-pressure which will produce the discharge pressure due to expansion after the beginning of reverse movement, by pushing the volume of the air high-pressure chamber 10*b* into the pre-pressure chamber 11*b*. At the beginning of the reverse movement, 15*a,* 13*a* and 12*b* must be opened and 12*a* and 13*b* must be closed simultaneously with the switchover of 28 (13*b* being forced into closing position by the oncoming pre-pressure piston 2). The switchover may be initiated by a proximity switch.

It should be emphasized here that the specific topological configuration is part of the invention and is particularly well suited for the repetitive thermodynamic process described; the special arrangement of pressure chambers and exchanger will permit the shuttle valve design avoiding dead volumes, which is essential to the principle of maximum efficiency conversion.

It should be pointed out finally that the pressure of the oil penetrating from the converter during each stroke is subject to variations at a ratio of about 1:30 (at 200 bar in the air storage 40), which will be an obstacle to the direct use of the converter in many applications, as the hydrostatic units have a displacement volume control range of 1:10 at most. If the converter is to operate at constant power the addition of a flywheel is recommended, which can bridge a wide range of cycle frequencies; the hydrostatic unit would only have to follow effective changes in load in that case.

If the converter is employed exclusively as a compressor, the forced control of the valves may be omitted, but the four-way switchover valve 28 must be synchronized with the stroke of the converter, either automatically (by the pressure peak at the stop) or by means of a proximity switch. In the instance of simple compression tasks (e.g., for cooling circuits) the compressor need not include a pre-pressure cylinder; the tubular heat exchanger may be chosen to be either stationary or movable in this case, as no buckling forces will arise.

What is claimed is:

1. Pneumo-hydraulic converter for the conversion of at least one of pneumatic power into hydraulic power and hydraulic power into pneumatic power, including a reciprocating piston, a gas working chamber which is partially defined by the piston and in which is provided a gaseous working medium, an oil working chamber which is partially defined by said piston and in which is provided a liquid working medium, an air storage tank connected to the gas working chamber by means of valves, and the oil working chamber connected to a hydraulic circuit, a rod connected to said piston, and a tubular heat exchanger which passes through the piston and is connected to an exterior cooling circuit which is designed to maintain the temperature of the gaseous working medium in the gas working chamber at an essentially constant level, said tubular heat exchanger including at least a portion extending outside of said rod.

2. Pneumo-hydraulic converter as claimed in claim 1, wherein said tubular heat exchanger is rigidly connected to said piston.

3. Pneumo-hydraulic converter as claimed in claim 1, wherein said reciprocating piston is a high-pressure piston and further including at least one pre-pressure piston with larger diameter.

4. Pneumo-hydraulic converter as claimed in claim 3, wherein at least one high-pressure piston is positioned between said oil working chamber and a gas high-pressure chamber, and wherein said gas working chamber is said high pressure chamber.

5. Pneumo-hydraulic converter as claimed in claim 3, wherein the pre-pressure piston is positioned between two gas pre-pressure chambers.

6. Pneumo-hydraulic converter as claimed in claim 1, wherein said reciprocating piston is one of two high-pressure pistons and one pre-pressure piston which are rigidly connected to one another.

7. Pneumo-hydraulic converter as claimed in claim 6, wherein the other of said two high-pressure pistons is positioned between an oil working chamber and a gas high-pressure chamber.

8. Pneumo-hydraulic converter as claimed in claim 6, wherein the pre-pressure piston is positioned between two gas pre-pressure chambers.

9. Pneumo-hydraulic converter as claimed in claim 1, wherein in order to prevent dead volumes said gas working chamber is connected to a corresponding pre-pressure chamber via a conical seat valve, which is guided on a tubular rod or the exchange pipes, and which occupies an entire wall thickness of a valve flange separating said gas working and pre-pressure chambers.

10. Pneumo-hydraulic converter as claimed in claim 1, including a proximity switch for control of the valves.

11. A pneumo-hydraulic converter which comprises:

an housing which defines a first end portion, a middle portion and a second end portion, a first piston which is reciprocatingly movable in said middle portion to define two varying volume pre-pressure air chambers on opposite sides of said first piston, a second piston which is reciprocatingly movable in said first end portion to define a first hydraulic chamber and a first high-pressure air chamber on opposite sides of said second piston, a third piston which is reciprocatingly movable in said second end portion to define a second hydraulic chamber and a second high-pressure air chamber on opposite sides of said third piston, a rod which is connected to and extends between said second piston and said third piston and through said first piston, and heat exchanger means which extends through said first end portion of said housing, through said second piston, outside of said rod, through said third piston, and through said second end portion of said housing to convey cooling media through said housing.

12. A pneumo-hydraulic converter according to claim 11, including a first cover at an end of said first end portion opposite said middle portion, said first cover including a first cooling media flow channel therethrough and a first hydraulic liquid flow channel therethrough, and wherein said heat exchanger means includes a first feeder pipe which extends from said first cover sealingly through said second piston and into a first interior space of said rod on a first side of said first piston to supply cooling media thereto from said first cooling media flow channel.

13. A pneumo-hydraulic converter according to claim 12, including a second cover at an end of said second end portion opposite said middle portion, said second cover including a second cooling media flow channel therethrough and a second hydraulic liquid flow channel therethrough, and wherein said heat exchanger means includes a second feeder pipe which extends from said second fitting cover sealingly through said third piston and into a second interior space of said rod on a second side of said first piston to remove cool media therefrom into said second cooling media flow channel.

14. A pneumo-hydraulic converter according to claim 13, including a plurality of heat exchange pipes around said rod to convey cooling media from said first interior space within said rod to said second interior space.

15. A pneumo-hydraulic converter according to claim 14, including an exterior circulation system connected between said second cooling media flow channel in said second corer with said first cooling media flow channel in said first cover.

16. A pneumo-hydraulic converter according to claim 15, wherein said exterior circulation system includes a pump and a heat exchanger.

17. A pneumo-hydraulic converter according to claim 12, including an eternal hydraulic liquid circulation system connected between said first hydraulic liquid flow channel in said first cover and said second hydraulic liquid flow channel in said second cover.

18. A pneumo-hydraulic converter according to claim 17, wherein said external hydraulic liquid circulation system includes a four-way valve.

19. A pneumo-hydraulic converter according to claim 2, including a high-pressure air delivery system for supplying high-pressure air to at least one of said first and second high-pressure air chambers.

* * * * *